US009289986B2

(12) United States Patent
Mallinson et al.

(10) Patent No.: US 9,289,986 B2
(45) Date of Patent: Mar. 22, 2016

(54) INKJET NOZZLE DEVICE CONFIGURED FOR MINIMIZING SATELLITE DROPLETS

(71) Applicant: MEMJET TECHNOLOGY LIMITED, Dublin (IE)

(72) Inventors: Sam Mallinson, North Ryde (AU); Glenn Horrocks, North Ryde (AU); Christopher Barton, North Ryde (AU); Giedre Milinkeviciute, North Ryde (AU); Chia-An Lin, North Ryde (AU); Aidan O'Mahony, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 14/624,448

(22) Filed: Feb. 17, 2015

(65) Prior Publication Data

US 2015/0251420 A1 Sep. 10, 2015

Related U.S. Application Data

(60) Provisional application No. 61/947,673, filed on Mar. 4, 2014.

(51) Int. Cl.
*B41J 2/06* (2006.01)
*B41J 2/14* (2006.01)
*B41J 2/045* (2006.01)

(52) U.S. Cl.
CPC ..... *B41J 2/14088* (2013.01); *B41J 2/04516* (2013.01); *B41J 2/1404* (2013.01); *B41J 2/1408* (2013.01); *B41J 2/1412* (2013.01)

(58) Field of Classification Search
CPC ..... B41J 2/04516; B41J 2/14088; B41J 2/14112; B41J 2/14016; B41J 2/14032
See application file for complete search history.

(56) References Cited

U.S. PATENT DOCUMENTS 7,431,432 B2 * 10/2008 Worsman et al. ..... 347/61

* cited by examiner

*Primary Examiner* — Juanita D Jackson
(74) *Attorney, Agent, or Firm* — Cooley LLP

(57) ABSTRACT

An inkjet nozzle device includes: a firing chamber having a nozzle aperture; and a heating element for generating gas bubbles in the firing chamber so as to eject ink through the nozzle aperture. A non-heating stabilizing bar extends across the nozzle aperture.

15 Claims, 4 Drawing Sheets

INKJET NOZZLE DEVICE CONFIGURED FOR MINIMIZING SATELLITE DROPLETS

FIELD OF THE INVENTION

This invention relates to inkjet printheads, such as thermal bubble-forming inkjet printheads. It is has been developed primarily for minimizing formation of satellite droplets during droplet ejection.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead in combination with a feed mechanism which feeds print media past the printhead in a single pass. Memjet® printers therefore provide much higher printing speeds than conventional scanning inkjet printers.

An inkjet printhead is comprised of a plurality (typically thousands) of individual inkjet nozzle devices, each supplied with ink. Each inkjet nozzle device typically comprises a firing chamber having a nozzle aperture and an actuator for ejecting ink through the nozzle aperture. The design space for inkjet nozzle devices is vast and a plethora of different nozzle devices have been described in the patent literature, including different types of actuators and different device configurations.

Satellite droplets (or 'satellites') are a perennial problem in the field of inkjet printheads. When an ink droplet is ejected from a nozzle aperture, there is a tendency for the tail of the droplet to break up into one or more trailing satellite droplets, each having a volume smaller than the main droplet. If ink droplets are ejected perfectly perpendicularly with respect to a nozzle plate of the printhead, then the satellites will tend to land on print media at the same position as the main droplet, causing minimal print artefacts.

However, inkjet nozzle devices usually have an inherent degree of asymmetry, which means that ink droplets may be ejected somewhat skewed from the nozzle plate of the printhead. With skewed droplet ejection, satellite droplets tend to land on print media at a different position than the main droplet and this causes a reduction in print quality.

Hitherto, most attempts to minimize the effects of satellites have focused on compensating for asymmetry in the nozzle device. For example, U.S. Pat. No. 7,780,271, the contents of which are herein incorporated by reference, describes an inkjet nozzle device having a heating element which is offset from the nozzle aperture. The offset compensates for asymmetric bubble formation in the firing chamber and enables non-skewed droplet ejection.

U.S. Pat. No. 8,267,501 (assigned to Eastman Kodak Company) describes inkjet nozzle devices having multi-lobed nozzle apertures. These multi-lobed nozzle apertures are reported to provide advantages, such as straighter trajectory, shorter tails, better accuracy, smaller ink volume, and less satellite effects.

For the sake of completeness, U.S. Pat. No. 5,812,159 (assigned to Eastman Kodak Company) describes inkjet nozzle devices comprising a heating bar extending across the nozzle aperture. The heating bar actuates droplet ejection by lowering the surface tension of an ink meniscus. With a positive ink pressure, this reduction in surface tension at the meniscus enables controlled droplet ejection upon actuation of the heating bar.

It would be desirable to provide an inkjet nozzle device, which minimizes satellite droplet formation and improves print quality.

SUMMARY OF INVENTION

In accordance with the present invention, there is provided an inkjet nozzle device comprising:

a firing chamber having a nozzle aperture; and a heating element for generating gas bubbles in the firing chamber so as to eject ink through the nozzle aperture, wherein a non-heating stabilizing bar extends across the nozzle aperture.

Inkjet nozzle devices according to the present invention exhibit reduced satellite droplet formation compared to inkjet nozzle devices lacking a stabilizing bar. Without wishing to be bound by theory, it is understood by the present inventors that the stabilizing bar provides more consistent venting of gas bubbles via the nozzle aperture. In conventional nozzle apertures, venting of gas bubbles tends to be a chaotic and non-repeatable process, which affects the consistency of droplet formation and results in a greater number of satellites. Experimentally, it has been observed that the stabilizing bar, which obscures part of the nozzle aperture, provides more consistent droplet formation with fewer satellites and improved overall print quality.

Preferably, the stabilizing bar extends parallel with the heating element (otherwise known in the art as a "resistive heating element" or simply "heater"). Preferably, a central longitudinal axis of the stabilizing bar is aligned with a central longitudinal axis of the heating element. Without wishing to be bound by theory, it is understood by the present inventors that, in conventional nozzle apertures, venting occurs preferentially at the parts of the nozzle aperture in line with the heating element. Advantageously, the stabilizing bar obscures this part of the nozzle aperture to provide more consistent and repeatable venting. Therefore, the stabilizing bar aligned with the heating element results in fewer satellites and improved overall print quality.

Preferably, the nozzle aperture comprises a pair of sub-apertures, the sub-apertures being defined symmetrically on either side of the stabilizing bar. Preferably, each sub-aperture is generally D-shaped.

Preferably, the nozzle aperture is symmetrical about a longitudinal axis and a transverse axis of the stabilizing bar. In other words, the nozzle aperture has mirror symmetry about two orthogonal axes.

In some embodiments, the nozzle aperture is circular and the stabilizing bar extends across a diameter of the nozzle aperture. In such embodiments, a width $W_s$ of the stabilizing bar and a diameter $d_1$ of the nozzle aperture may be in a ratio $2<d_1/W_s<10$, or preferably a ratio $3<d_1/W_s<6$ In other embodiments, the nozzle aperture is elliptical and the stabilizing bar extends across a major axis of the nozzle aperture. In such embodiments, a width $W_s$ of the stabilizing bar and a minor axis $d_2$ of the nozzle aperture may be in a ratio $2<d_2/W_s<10$, or preferably a ratio $3<d_2/W_s<6$.

Typically, the stabilizing bar obscures from 5 to 50%, or 10 to 40% of an area of the nozzle aperture, relative to a nozzle aperture lacking the stabilizing bar.

Preferably, a width $W_h$ of the heating element and a width $W_s$ of the stabilizing bar are in a ratio of $0.1<W_s/W_h<5$, or preferably a ratio $0.5<W_s/W_h<1.25$. In some embodiments, $W_s=W_h$. Typically, the heating element and stabilizing bar are aligned with each other, as described above.

Preferably, the stabilizing bar is coplanar with a roof of the firing chamber, the roof having the nozzle aperture defined therein.

Preferably, the stabilizing bar and the roof are comprised of a same material. Thus, nozzle apertures having the stabilizing bar may be readily fabricated by suitably modifying a mask used for etching the nozzle apertures. Therefore, inkjet nozzle devices according to the present invention do not require any extra fabrication steps compared to conventional devices.

The heating element may be bonded to a floor of the firing chamber or suspended within the firing chamber. Inkjet nozzle devices comprising bonded heating elements are ubiquitous in commercially-available thermal inkjet printers and will be well known to the person skilled in the art. By way of example only, the inkjet nozzle device may be as described in U.S. Application No. 61/859,889 filed on 30 Jul. 2013, the contents of which are herein incorporated by reference. Examples of suspended heating elements may be found in, for example, U.S. Pat. No. 6,755,509, the contents of which are herein incorporated by reference.

The present invention further provides an inkjet printhead having a plurality of nozzle apertures, wherein a non-heating stabilizing bar extends across each nozzle aperture. Preferably, the printhead comprises a plurality of inkjet nozzle devices as described herein.

BRIEF DESCRIPTION OF THE DRAWINGS

Embodiments of the present invention will now be described by way of example only with reference to the accompanying drawings, in which.

DETAILED DESCRIPTION OF AN EMBODIMENT OF THE INVENTION

Figure 1:
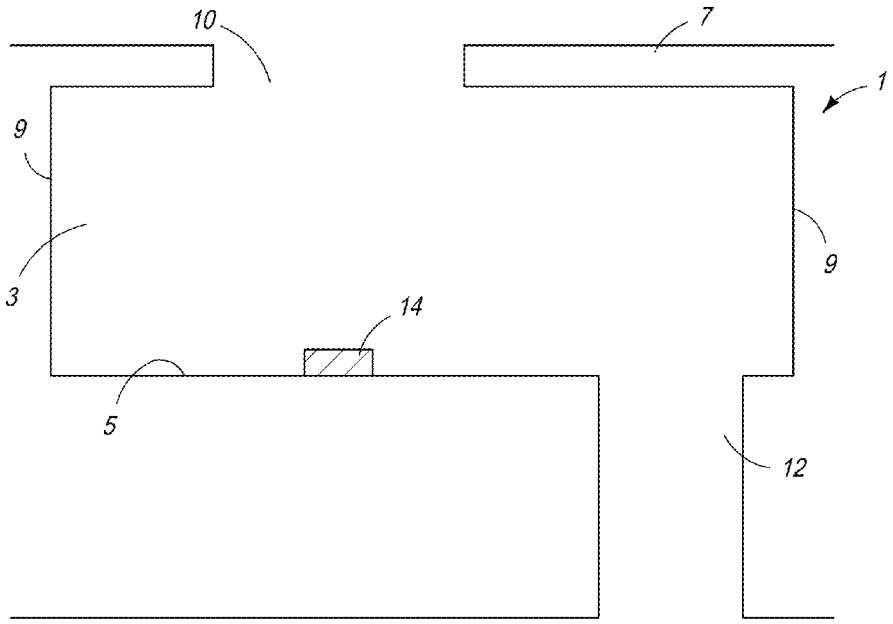
FIG. 1 (PRIOR ART)
FIG. 1 is a schematic sectional side view of a prior art inkjet nozzle device.

Referring initially to FIG. 1, there is shown a schematic sectional side view of a prior art inkjet nozzle device 1 comprising a firing chamber 3 having a floor 5, a roof 7 and sidewalls 9 extending between the floor and the roof. A nozzle aperture 10 is defined in the roof 7 and a chamber inlet 12 is defined in the floor 5. However, it will be appreciated that the chamber inlet may be alternatively defined in one of the sidewalls 9 of the firing chamber 3.

Figure 2:
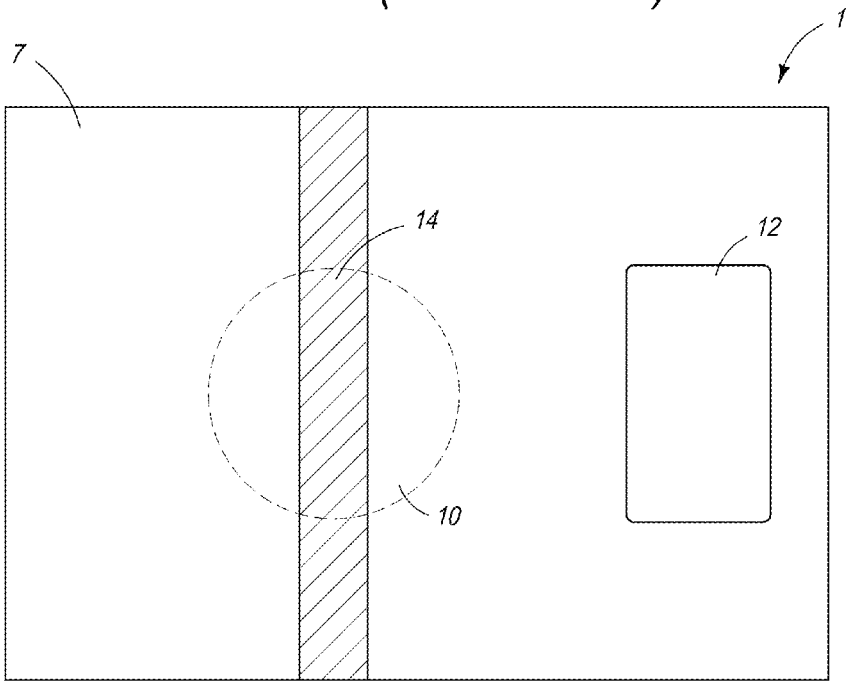
FIG. 2 (PRIOR ART)
FIG. 2 is a plan view of the prior art inkjet nozzle device shown in FIG. 1.

Referring now to FIGS. 1 and 2, a heating element 14 is bonded to the floor 5 of the firing chamber 3 directly below the nozzle aperture 10. The heating element 14 takes the form of an elongate rectangular bar, having a central longitudinal axis aligned with a diameter of the nozzle aperture 10. Although a circular nozzle aperture 10 is shown in FIG. 2, it will be appreciated that the nozzle aperture may be elliptical having a major axis aligned with the central longitudinal axis of the heating element, as described in, for example, U.S. Pat. No. 7,857,428 and U.S. Application No. 61/859,889 filed on 30 Jul. 2013, the contents of which are herein incorporated by reference.

Figure 3:
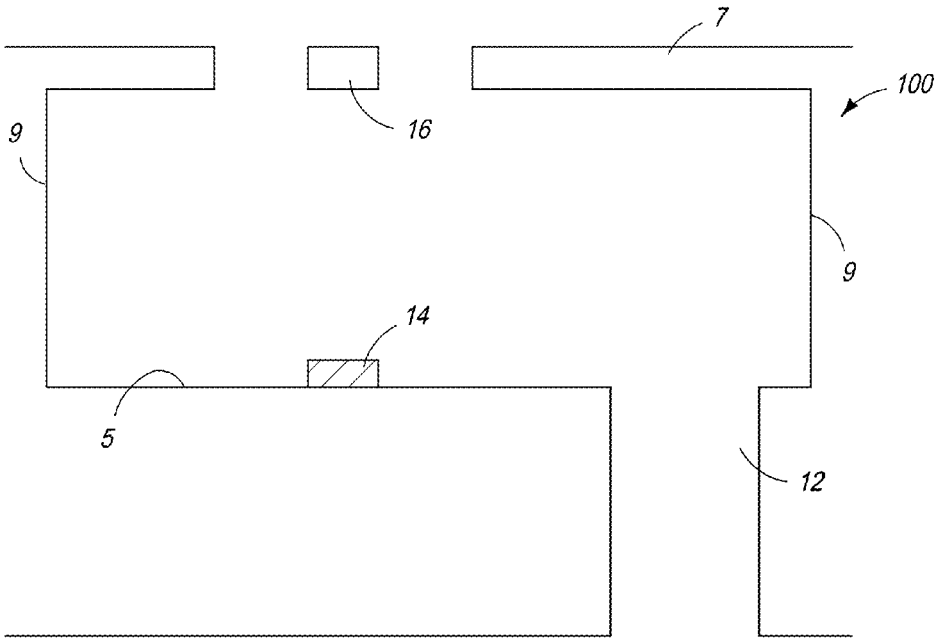
FIG. 3 is a schematic sectional side view of an inkjet nozzle device according to the present invention.
Figure 4:
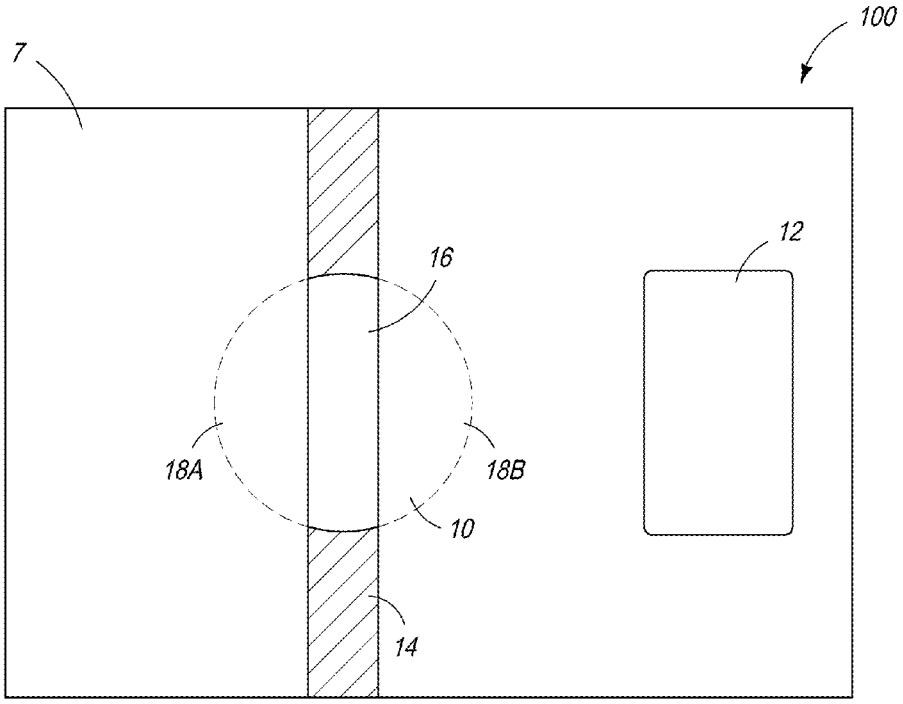
FIG. 4 is a plan view of the inkjet nozzle device shown in FIG. 3.

Turning to FIGS. 3 and 4, there is shown one embodiment of an inkjet nozzle device 100 according to the present invention. The inkjet nozzle device 100 is identical to the prior art inkjet nozzle device 1 in every respect, with the exception that the inkjet nozzle device 100 comprises a stabilizing bar 16 extending across the nozzle aperture 10.

For the sake of clarity, like reference numerals are used to indicate like features in the prior art inkjet nozzle device 1 and the inkjet nozzle device 100 in FIGS. 1 to 4. Further, for the avoidance of doubt, the roof 7 in FIGS. 2 and 4 is shown as a transparent structure to reveal details of the heating element 14 and chamber inlet 12 below the roof Referring to FIG. 4, the stabilizing bar 16 extends parallel with the heating element 14, and has a central longitudinal axis aligned with the central longitudinal axis of the heating element. The stabilizing bar is comprised of the same material as the roof 7 and is, therefore, entirely passive and non-heating. Typically, the roof is comprised of a ceramic material, such as silicon nitride, silicon oxide and combinations thereof or the roof is comprised of a polymer material, such as an epoxy-based photoresist (e.g. SU-8). As shown in FIG. 3, the stabilizing bar 16 is coplanar with the roof 7, being defined by suitably modifying a mask used for etching the roof.

By virtue of the stabilizing bar 16 bisecting the nozzle aperture 10, the nozzle aperture comprises a pair of sub-apertures 18A and 18B, which are defined symmetrically on either side of the stabilizing bar. Each of the sub-apertures 18A and 18B is generally D-shaped, having a straight edge defined by one longitudinal edge of the stabilizing bar 16. It will be readily apparent that the nozzle aperture 10 is symmetrical about a longitudinal axis and an orthogonal transverse axis of the stabilizing bar 16.

The relative dimensions of the stabilizing bar 16, the heating element 14 and the nozzle aperture are not particularly limited, and suitable ranges for these dimensions are described hereinabove. For example, as shown in FIG. 4, the stabilizing bar 16 has about the same width as the heating element 14, and the stabilizing bar obscures about a quarter of the diameter of the nozzle aperture 10.

Although not exemplified in the drawings, this invention contemplates other nozzle aperture shapes aside from circular nozzle apertures. For example, elliptical nozzle apertures having a major axis aligned with a longitudinal axis of the heating element 14 are within the ambit of the present invention. In such embodiments having elliptical nozzle apertures, the stabilizing bar 16 extends along the major axis of the elliptical nozzle aperture so as to be aligned with the heating element 14.

Figure 5:
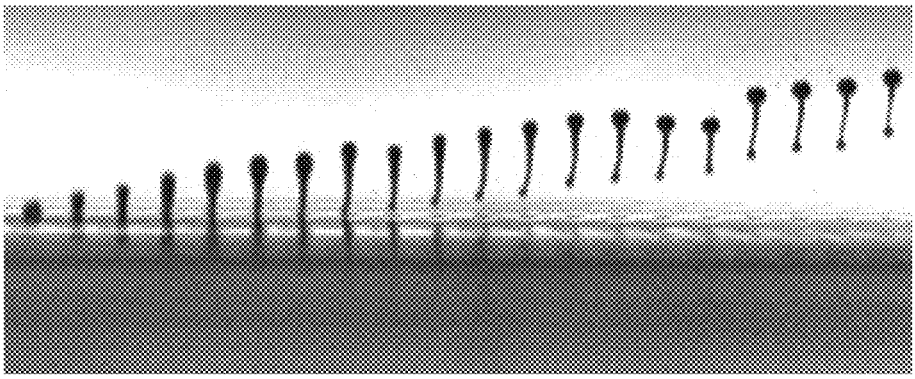
FIG. 5 is a photograph of ink droplets ejected from a printhead having the prior art inkjet nozzle devices.
Figure 6:
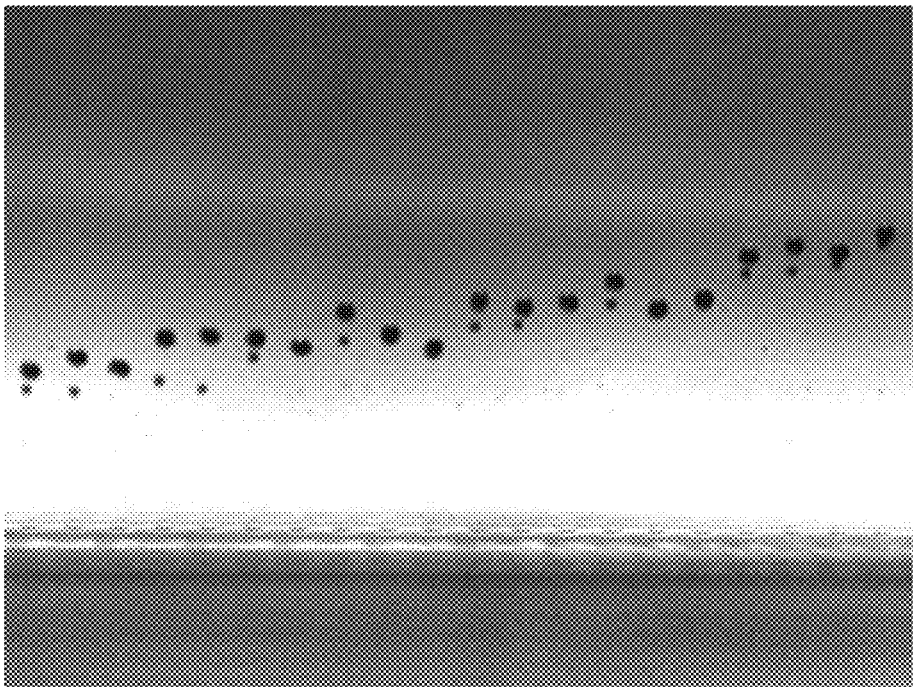
FIG. 6 is a photograph of the ink droplets shown in FIG. 5 captured at a later time.

Referring now to FIGS. 5 to 8, the advantages of the present invention have been demonstrated experimentally using real-time photographs of ejected ink droplets. FIGS. 5 and 6 show ink droplets ejected from the prior art inkjet nozzle device 1 shown in FIGS. 1 and 2. In FIG. 5, when the ink droplets are still relatively close to the printhead, each ink droplet has a relatively long tail, which creates instability in the main droplet. As shown in FIG. 6, when the ink droplets are relatively further from the printhead, a number of trailing satellite droplets can be seen. These satellite droplets are a cause of reduced print quality.

Figure 7:
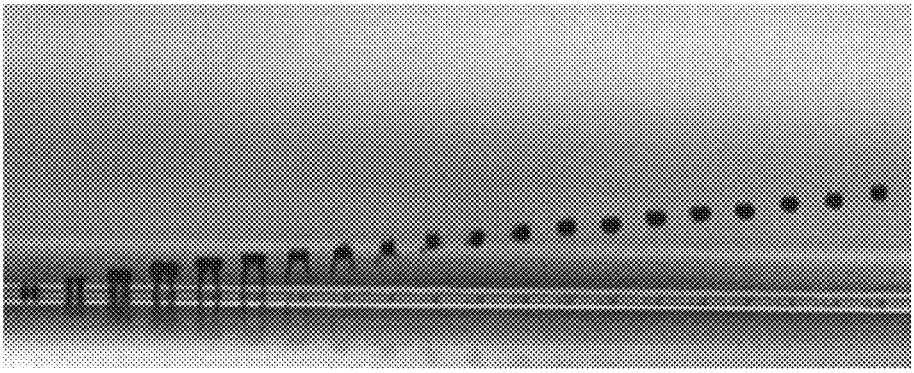
FIG. 7 is a photograph of ink droplets ejected from a printhead having the inkjet nozzle devices according to the present invention.
Figure 8:
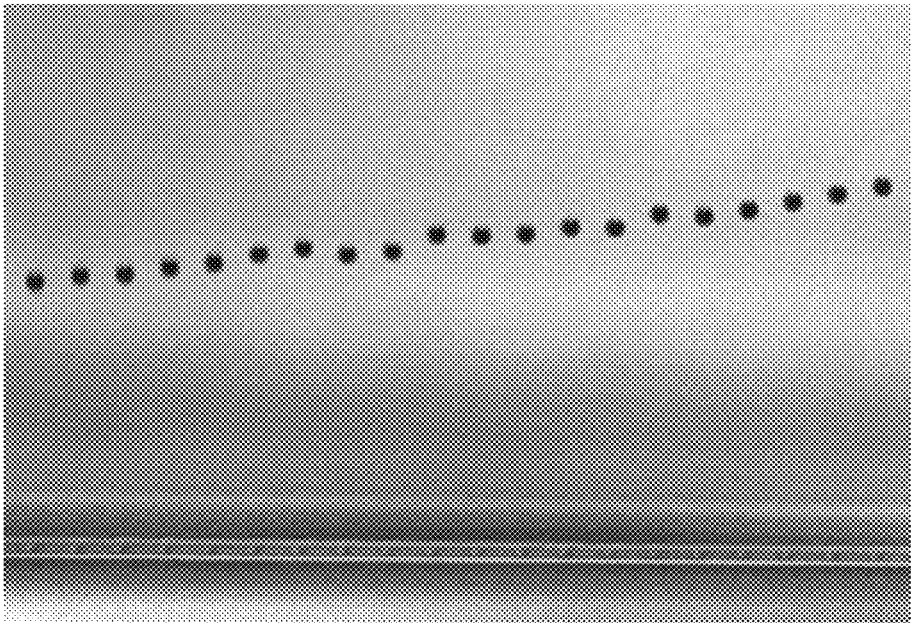
FIG. 8 is a photograph of the ink droplets shown in FIG. 7 captured at a later time.

By contrast, FIGS. 7 and 8 show ink droplets ejected from the inkjet nozzle device 100 shown in FIGS. 3 and 4. As is clearly evident from FIGS. 7 and 8, the ejected ink droplets are much cleaner with no trailing satellite droplets. Accordingly, print quality is improved using the inkjet nozzle device according to the present invention.

It will, of course, be appreciated that the present invention has been described by way of example only and that modifications of detail may be made within the scope of the invention, which is defined in the accompanying claims.

The invention claimed is:

1. An inkjet nozzle device comprising:

a firing chamber having a nozzle aperture defined in a roof thereof; and a heating element for generating gas bubbles in the firing chamber so as to eject ink through the nozzle aperture, wherein a non-heating stabilizing bar extends continuously across the nozzle aperture, the stabilizing bar being coplanar with the roof of the firing chamber and having a same thickness as the roof.

2. The inkjet nozzle device of claim 1, wherein the stabilizing bar extends parallel with the heating element.

3. The inkjet nozzle device of claim 2, wherein a longitudinal axis of the stabilizing bar is aligned with a longitudinal axis of the heating element.

4. The inkjet nozzle device of claim 3, wherein the nozzle aperture is circular and the stabilizing bar extends across a diameter of the nozzle aperture.

5. The inkjet nozzle device of claim 4, wherein a width Ws of the stabilizing bar and a diameter d1 of the nozzle aperture are in a ratio $2 \leq d1/Ws \leq 10$.

6. The inkjet nozzle device of claim 3, wherein the nozzle aperture is elliptical and the stabilizing bar extends across a major axis of the nozzle aperture.

7. The inkjet nozzle device of claim 6, wherein a width Ws of the stabilizing bar and a minor axis d2 of the nozzle aperture are in a ratio $2 \leq d2/Ws \leq 6$.

8. The inkjet nozzle device of claim 1, wherein the nozzle aperture comprises a pair of sub-apertures, the sub-apertures being defined symmetrically on either side of the stabilizing bar.

9. The inkjet nozzle device of claim 8, wherein each sub-aperture is generally D-shaped.

10. The inkjet nozzle device of claim 1, wherein the nozzle aperture is symmetrical about a longitudinal axis and a transverse axis of the stabilizing bar.

11. The inkjet nozzle device of claim 1, wherein the stabilizing bar obscures from 10 to 40% of an area of the nozzle aperture.

12. The inkjet nozzle device of claim 1, wherein a width Wh of the heating element and a width Ws of the stabilizing bar are in a ratio of $0.1 \leq Ws/Wh \leq 5$.

13. The inkjet nozzle device of claim 1, wherein the stabilizing bar and the roof are comprised of a same material.

14. The inkjet nozzle device of claim 1, wherein the heating element is bonded to a floor of the firing chamber.

15. An inkjet printhead comprising a plurality of nozzle devices according to claim 1.

* * * * *